US009551311B2

(12) United States Patent
Agresta et al.

(10) Patent No.: US 9,551,311 B2
(45) Date of Patent: Jan. 24, 2017

(54) NOZZLE BODY, THE VALVE ASSEMBLY AND FLUID INJECTION VALVE

(71) Applicant: Continental Automotive GmbH, Hannover (DE)

(72) Inventors: Antonio Agresta, Pisa (IT); Marco Maragliulo, San Miniato (IT); Marco Mechi, Vada (IT); Marco Fiaschi, Cascina (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 14/753,649

(22) Filed: Jun. 29, 2015

(65) Prior Publication Data

US 2016/0017854 A1 Jan. 21, 2016

(30) Foreign Application Priority Data

Jul. 17, 2014 (EP) ..... 14177374

(51) Int. Cl.
*B05B 1/30* (2006.01)
*F02M 61/18* (2006.01)
*F02M 63/00* (2006.01)

(52) U.S. Cl.
CPC ..... *F02M 61/184* (2013.01); *F02M 61/1866* (2013.01); *F02M 63/0012* (2013.01)

(58) Field of Classification Search
CPC .... F02M 55/068; F02M 55/04; F02M 51/061; F02M 51/0625; F23D 11/383; F23D 11/24
USPC ..... 239/533.2, 533.12, 585.5
See application file for complete search history.

(56) References Cited

U.S. PATENT DOCUMENTS 4,057,190 A * 11/1977 Kiwior ..... F02M 51/0675 239/533.12
6,045,063 A 4/2000 Koike et al. ..... 239/533.3
2001/0022170 A1 9/2001 Okamoto et al. ..... 123/432

FOREIGN PATENT DOCUMENTS

EP 2711536 A1 3/2014 ..... F02M 61/18
EP 2884090 A1 6/2015 ..... F02M 61/18
FR 2860557 A1 4/2005 ..... F02M 61/18
JP 5231153 A 9/1993 ..... F02B 23/06

OTHER PUBLICATIONS

European Search Report, Application No. 14177374.7, 6 pages, Jan. 16, 2015.

* cited by examiner

*Primary Examiner* — Davis Hwu
(74) *Attorney, Agent, or Firm* — Slayden Grubert Beard PLLC

(57) ABSTRACT

A nozzle body for a fluid injection includes a cavity and a bottom wall delimiting the cavity at a fluid outlet end. The bottom wall is perforated by an injection hole having an inlet opening at an inner surface of the bottom wall and an outlet opening at an outer surface of the bottom wall. The outlet opening has an elongated slit shape having a centerline which is a circular arc with respect to the longitudinal axis. The inlet opening is spaced apart from the longitudinal axis by a radial distance. The inner surface has a concave shape extending away from the fluid outlet end from an apex of the inner surface. Further, the inlet opening is spaced apart from the apex by an axial distance that is smaller than said radial distance.

17 Claims, 2 Drawing Sheets

NOZZLE BODY, THE VALVE ASSEMBLY AND FLUID INJECTION VALVE

CROSS-REFERENCE TO RELATED APPLICATIONS

This application claims priority to EP Application No. 14177374 filed Jul. 17, 2014, the contents of which are hereby incorporated by reference in their entirety.

TECHNICAL FIELD

The present disclosure relates to a nozzle body for a fluid injection valve, to a valve assembly for a fluid injection valve and to a fluid injection valve.

BACKGROUND

A fuel injector for injecting fuel into a combustion engine typically comprises a valve that can be opened by means of an electrically driven actuator. Different designs for such fuel injection valves are known in the art. Many known designs suffer from poor vaporization of the fluid dispensed through the injection hole and/or imprecise dosing of the fluid, e.g., due to an insufficiently fast closing caused by an inadequate hydraulic force on the valve needle in the closing direction.

SUMMARY

One embodiment provides a nozzle body for a fluid injection valve having a cavity which extends along a longitudinal axis towards a fluid outlet end and having a bottom wall delimiting the cavity at the fluid outlet end, wherein the bottom wall is perforated by an injection hole which has an inlet opening at an inner surface of the bottom wall and an outlet opening at an outer surface of the bottom wall, wherein the outlet opening is in the shape of an elongated slit having a centerline which is a circular arc with respect to the longitudinal axis, wherein the inlet opening is spaced apart from the longitudinal axis by a radial distance, wherein the inner surface has a concave shape extending away from the fluid outlet end from an apex of the inner surface, and wherein the inlet opening is spaced apart from the apex by an axial distance which is smaller than said radial distance.

In a further embodiment, the axial distance is half of the radial distance or less.

In a further embodiment, the nozzle body comprises one or more further injection holes each having an inlet opening at the inner surface of the bottom wall and an outlet opening at the outer surface of the bottom wall, each outlet opening being in the shape of an elongated slit having a centerline which is a circular arc with respect to the longitudinal axis, the center lines of the injection hole and the at least one further injection hole being positioned on a common imaginary circle around the longitudinal axis.

In a further embodiment, the outer surface has a dome-shaped portion and an axial distance of the outlet opening from an apex of the dome-shape is smaller than a radial distance of the outlet opening to the longitudinal axis.

In a further embodiment, the inner surface has a flat central portion comprising the apex of the inner surface, a first truncated cone shaped portion upstream of the flat central portion, a cylindrical portion upstream of the first truncated cone shaped portion and a second truncated cone shaped portion upstream of the cylindrical portion, the inlet opening being comprised by the second truncated cone shaped portion.

Another embodiment provides a valve assembly for a fluid injection valve comprising a nozzle body as disclosed above and a seat element which, in a closing position, abuts a valve seat comprised by the inner surface for sealing the injection hole and is displaceable away from the valve seat for unsealing the injection hole.

In a further embodiment, the valve seat is comprised by the second truncated cone shaped portion.

In a further embodiment, the seat element has a spherical shape at least in the region where it abuts the valve seat in the closing position.

Another embodiment provides a fluid injection valve comprising a valve assembly as disclosed above.

BRIEF DESCRIPTION OF THE DRAWINGS

Example embodiments are discussed in detail below with reference to the figures, in which.

DETAILED DESCRIPTION

Figure 1:
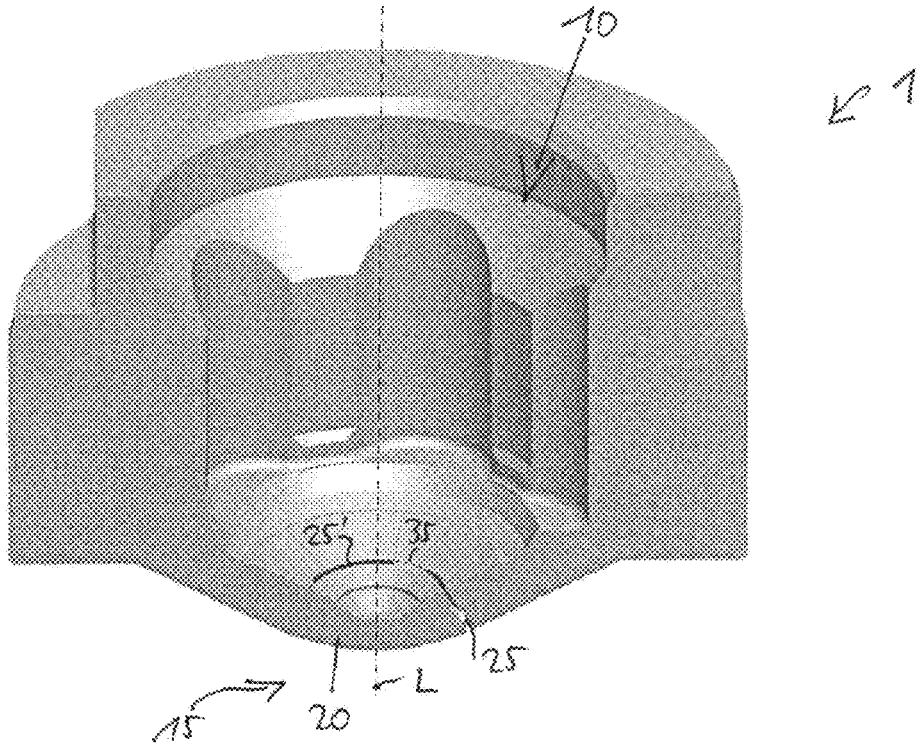
FIG. 1 shows a longitudinally cut perspective view of a nozzle body according to an embodiment of the invention.

Embodiments of the invention provide a nozzle body for a fluid injection valve by means of which particularly good injection characteristics of the fluid injection valve are achievable.

A nozzle body for a fluid injection valve is disclosed according to one aspect. According to a further aspect, a valve assembly comprising the nozzle body is disclosed. According to yet another aspect, a fluid injection valve comprising the valve assembly is disclosed. The fluid injection valve is in particular a fuel injection valve for an internal combustion engine.

The nozzle body has a cavity which extends along the longitudinal axis towards a fluid outlet end. It further has a bottom wall which delimits the cavity at the fluid outlet end. For example, the nozzle body has a sidewall extending circumferentially around the longitudinal axis from a fluid inlet end of the nozzle body to the fluid outlet end. It may expediently define the cavity together with the bottom wall. Expediently, the sidewall may merge with the bottom wall at the fluid outlet end of the sidewall. Preferably, the bottom wall extends in curved and/or obliquely fashion with respect to the longitudinal axis. In particular, it intersects the longitudinal axis.

The bottom wall is perforated by an injection hole. More specifically, the bottom wall has an inner surface and an outer surface. In particular, the inner surface faces the cavity and the outer surface faces away from the cavity and is arranged subsequent to the inner surface in direction towards the fluid outlet end along the longitudinal axis. The injection hole has an inlet opening at the inner surface of the bottom wall and an outlet opening at the outer surface of the bottom wall. In other words, the inner surface is perforated by the inlet opening and the outer surface is perforated by the outlet opening. The injection hole may expediently extend through the wall from the inlet opening to the outlet opening. Fluid may enter the injection hole from the cavity through the inlet opening and may be dispensed from the nozzle body through the outlet opening.

The outlet opening is in the shape of an elongated slit. It has a centerline which is a circular arc with respect to the longitudinal axis. In one embodiment, the inlet opening is also in the shape of an elongated slit which has a centerline which is a circular arc with respect to the longitudinal axis. The outlet opening may have a length which is longer than the length of the inlet opening, the length being in this context in particular the length of the centerlines.

The inner surface of the bottom wall has a concave shape which extends away from the fluid outlet end from an apex of the inner surface. To put it differently, the inner surface is cup shaped and opens in axial direction away from the fluid outlet end from a bottom of the cup shape. The apex is in particular the point on the inner surface which is positioned closest to the fluid outlet end. Preferably, the longitudinal axis intersects the inner surface at the apex.

The inlet opening is spaced apart from the longitudinal axis by a radial distance and spaced apart from the apex of the inner surface by an axial distance.

The axial distance is smaller than the radial distance. In an advantageous embodiment, the axial distance is half of the radial distance or less.

With advantage, a particularly good vaporization of the fluid dispensed through the injection hole and a particular precise dosing of the fluid is achievable by means of the shape and position of the injection hole as described above. The nozzle body according to the present disclosure may effect a particularly high hydraulic force on a valve needle of the valve assembly.

The hydraulic force acts in the closing direction of the valve needle so that a particularly fast closing transient and, thus, a particularly precise dosing of the fluid is achievable. In addition, by means of the relation between the axial distance and the radial distance, a particularly small dead volume of the nozzle body is achievable so that the risk of unwanted late injection is particularly small.

According to one embodiment, the nozzle body comprises one or more further injection holes. Each further injection hole has an inlet opening at the inner surface of the bottom wall and an outlet opening at the outer surface of the bottom wall. Each outlet opening of the one or more further injection holes is in the shape of an elongated slit having a centerline which is a circular arc with respect to the longitudinal axis. In one embodiment, also the inlet opening or openings may be in the shape of an elongated slit having a centerline which is a circular arc with respect to the longitudinal axis in each case. The centerlines of the outlet openings of the injection hole and the one or more further injection holes are preferably positioned on the common imaginary circle around the longitudinal axis. In one embodiment, the centerlines of the inlet openings of the injection hole and the one or more further injection holes are positioned on a further, common imaginary circle around the longitudinal axis. In one development, the further circle has a smaller diameter than the circle comprising the centerlines of the outlet openings. The outlet openings and/or the inlet openings are preferably evenly spaced in circumferential direction around the longitudinal axis. With advantage, a particularly homogeneous spray distribution is achievable in this way.

In one embodiment, the outer surface of the bottom wall has a dome shaped portion and an axial distance of the outlet opening of the injection hole from an apex of the dome shape is smaller than a radial distance of the outlet opening to the longitudinal axis. Such a configuration may be advantageous with respect to the formation of deposits on the outer surface and/or with respect to achieving a particularly small dead volume. The longitudinal axis may intersect the outer surface at the apex of the dome shape.

In one embodiment, the inner surface has a flat central portion which comprises the apex of the inner surface, i.e. in this case in particular the intersection of the flat central portion with the longitudinal axis. It further has a first truncated cone shaped portion which is positioned upstream of the flat central portion. In addition, the inner surface may comprise a cylindrical portion which is positioned upstream of the first truncated cone shaped portion and a second truncated cone shaped portion upstream of the cylindrical portion. Preferably, the outer contour of the flat central portion merges with an inner contour of the first truncated cone shaped portion, an outer contour of the first truncated cone shaped portion merges with a bottom edge of the cylindrical portion, and the top edge of the cylindrical portion merges with an inner contour of the second truncated cone shaped portion. The inlet opening is preferably comprised by the second truncated cone shaped portion. An inner surface having such a shape is advantageously easily and precisely producible. Advantageous flow characteristics and a particularly small dead volume are achievable by such an inner surface.

In one embodiment, the valve assembly comprises the nozzle body and a seat element. The seat element may be comprised by a valve needle of the valve assembly. In particular, the seat element represents an axial end of the valve needle which faces towards the fluid outlet end.

Expediently, the inner surface comprises a valve seat. The seat element and the valve seat interact for sealing and unsealing the injection hole. More specifically, the seat element, in a closing position, abuts the valve seat for sealing the injection hole and is displaceable away from the valve seat—in particular in axial direction away from the fluid outlet end—for unsealing the injection hole. In one embodiment, the seat element has a spherical shape, in particular at least in the region where it abuts the valve seat in the closing position. In another embodiment, the valve seat is comprised by the second truncated cone shaped portion.

Further advantages, advantageous embodiments and developments of the nozzle body, the valve assembly and the fluid injection valve will become apparent from the exemplary embodiments which are described below in association with schematic figures.

FIG. 1 shows a perspective view of a nozzle body 1, cut open for better visibility of the interior of the nozzle body 1 along a plane comprising a longitudinal axis L of the nozzle body 1.

The nozzle body 1 extends along the longitudinal axis L from a fluid inlet end 12 to a fluid outlet end 15.

Figure 3:
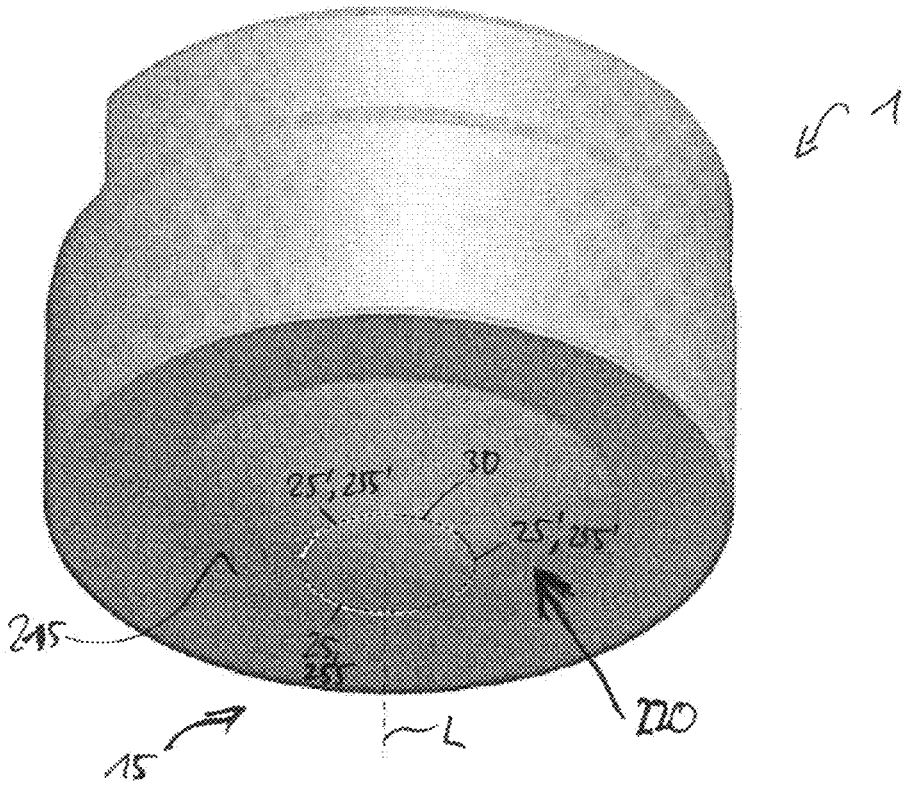
FIG. 3 shows another perspective view of the nozzle body.
Figure 4:
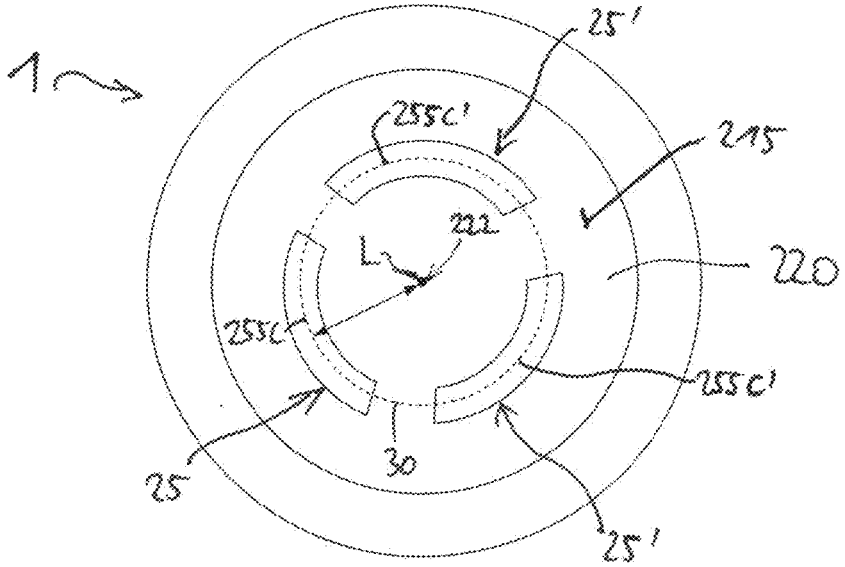
FIG. 4 shows a schematic top view of the nozzle body.

FIG. 3 shows another perspective view—onto the fluid outlet end 15—of the nozzle body 1. FIG. 4 shows a top view of the fluid outlet end 15.

Figure 2:
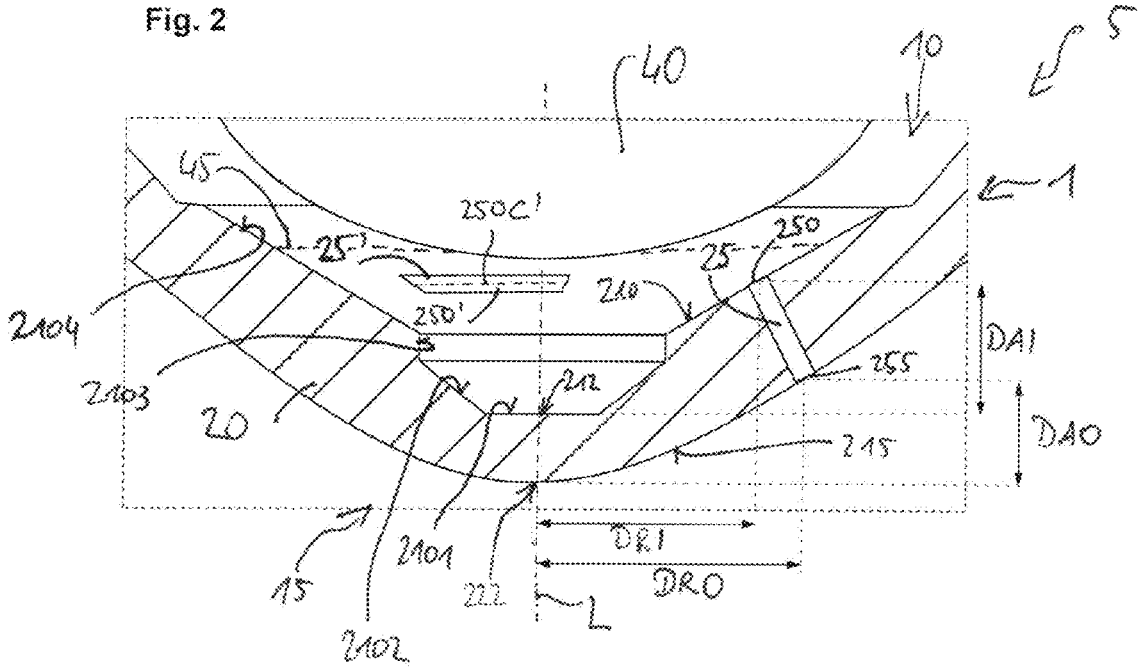
FIG. 2 shows a schematic longitudinal section view of a portion of a valve assembly of a fuel injector with the nozzle body of FIG. 1.

FIG. 2 shows a longitudinal section view of a portion of a fuel injection valve, more specifically of a valve assembly 5 of the fuel injection valve. The valve assembly 5 comprises the nozzle body 1 according to FIGS. 1, 3 and 4.

The nozzle body 1 has a side wall 17 and a bottom wall 20. The side wall 17 extends circumferentially around the longitudinal axis L while the bottom wall 20 intersects the longitudinal axis L. The side wall 17 extends from the fluid inlet end 12 to the fluid outlet end 15 and merges with the bottom wall 20 at the fluid outlet end 15.

The side wall 17 and the bottom wall 20 define a cavity 10 of the nozzle body 1 which extends in longitudinal direction through the nozzle body 1 from the fluid inlet end 12 to the bottom wall 20 where it is delimited by the bottom wall 20. The bottom wall 20 has an inner surface 210 which faces the cavity 10 and an outer surface 215 facing away from the cavity 10. In one embodiment, the fuel injection valve is configured for injecting fuel directly into a combustion chamber of an internal combustion engine. In this case, the outer surface 215 is in particular exposed to the combustion chamber during operation of the fuel injection valve.

The bottom wall 20 is perforated by a plurality of injection holes 25, 25'—being denoted as an injection hole 25 and further injection holes 25'. For example, the nozzle body 1 has three injection holes. Other numbers of injection holes 25, 25' are also conceivable.

In the present embodiment, the injection hole 25 and the further injection holes 25' are of identical construction. Therefore the description may be limited to only the injection hole 25 in the following, although it will be pertinent also for the other injection holes 25' (unless the contrary is explicitly stated). However, it is also conceivable that at least two injection holes 25, 25' are shaped and/or positioned differently.

The inner surface 210 of the nozzle body 1 comprises a valve seat 45 which is configured for interacting with a seat element 40 of the valve assembly 5 to seal and unseal the injection holes 25, 25'. Specifically, the seat element 40 sealingly rests on the inner surface 210 at the valve seat 45 in a closing position of the seal element 40 and is axially displaceable away from the closing position to open a gap between the valve seat 45 and the sealing element 40 so that fluid can flow from the fluid inlet end 12 through the gap to the injection holes 25, 25' to be dispensed through the injection holes 25, 25' from the nozzle body 1. The seat element 40 has a generally spherical shape (cf. e.g. FIG. 2).

The injection holes 25, 25' each have an inlet opening 250, 250' which is positioned at the inner surface 210 of the bottom wall 20. An outlet opening 255, 255' of each injection hole 25, 25' is positioned at the outer surface 215 of the bottom wall 20. The outlet opening 255, 255' is in the shape of an elongated slit which has a centerline 255C, 255C' which is a circular arc with respect to the longitudinal axis L. In other words, the outlet openings 255, 255' extend in arcuate fashion around the longitudinal axis L and the dimension of the outlet openings 255C, 255C' in radial direction is much smaller than in circumferential direction, for example by a factor of 10 or more.

The outlet openings 255, 255' are arranged on a common imaginary circle 30 around the longitudinal axis L (best seen in FIG. 4). To put it differently, the centerlines 255C, 255C' are sections of the circle 30 around the longitudinal axis L. Therefore, the outlet openings 255, 255' are each spaced apart from the longitudinal axis L by a radial distance DRO which is in the present case the radius of the circle 30.In the present embodiment, the outlet openings 255, 255' are in addition evenly spaced in circumferential direction.

In the present embodiment, also the inlet openings 250, 250' are in the shape of an elongated slits with centerlines 250C, 250C' which are circular arcs with respect to the longitudinal axis L. The center lines 250C, 250C' are sections of a further, common circle 35 around the longitudinal axis L (see in particular FIGS. 1 and 2). Therefore, the inlet openings 250, 250' are each spaced apart from the longitudinal axis L by a radial distance DRI which is in the present case the radius of the further circle 35.

In the present embodiment, the circumferential length of the injection hole 25, 25' increases monotonously in the course from the inlet opening 250, 250' to the outlet opening 255, 255'. In addition, the radial distance DRO of the outlet openings 255, 255' from the longitudinal axis L is larger than the radial distance DRI of the inlet openings 250, 250' from the longitudinal axis L, so that a hollow cone shaped spray pattern is achievable.

The inner surface 210 is cup-shaped, sometimes also being denoted as bowl-shaped, and opens concavely from an apex 212 in direction away from the fluid outlet end 15. More specifically, the inner surface 210 has a flat central portion 2101 which is intersected by the longitudinal axis L, the intersection point defining an apex 212 of the inner surface 210. A first truncated cone shaped portion 2102 of the inner surface 210 extends completely circumferentially around the flat central portion 2101. An inner contour of the first truncated cone shaped portion 2102 adjoins an outer circumferential edge of the flat central portion. The first truncated cone shaped portion 2102 extends from its inner contour in upstream direction, i.e. in axial direction away from the fluid outlet end 15, where the first truncated cone shaped portion 2102 has an outer contour that merges with a cylindrical portion 2103 of the inner surface 210. The cylindrical portion 2103 is arranged upstream of the first truncated cone shaped portion 2102. A circumferential edge of the cylindrical portion 2103 which is remote from the first truncated cone shaped portion 2102 merges with a second truncated cone shaped portion 2104 of the inner surface 210. The valve seat 45 and the inlet openings 250, 250' are comprised by the second truncated cone shaped portion 2104. Expediently, the valve seat 45 is positioned upstream of the inlet openings 250, 250'.

The outer surface 215 has a dome-shaped central portion 220 which comprises the outlet openings 255, 255'. The longitudinal axis L intersects the dome shaped portion 220 of the outer surface 215 at an apex 222 of the dome shape. In the present embodiment, the outer surface 215 has a ring portion extending around the dome shaped portion 220, the ring portion being generally perpendicular to the longitudinal axis L.

In the present embodiment, an axial distance DAI by which the inlet openings 250, 250' are spaced apart from the apex 212 of the inner surface 250 is less than half of the radial distance DRI by which the inlet openings 250, 250' are spaced apart from the longitudinal axis L. An axial distance DAO by which the outlet openings 255, 255' are spaced apart from the apex 222 of the outer surface 215 is smaller than the radial distance DRO of the outlet openings 255, 255' to the longitudinal axis L by a factor of two or more.

What is claimed is:

1. A nozzle body for a fluid injection valve, comprising:

a cavity extending along a longitudinal axis towards a fluid outlet end and having a bottom wall delimiting the cavity at the fluid outlet end, wherein the bottom wall includes an inner surface with a concave shape extending along the longitudinal axis away from an apex of the cavity disposed at the fluid outlet end, an injection hole perforating the bottom wall with an inlet opening at the inner surface of the bottom wall and an outlet opening at an outer surface of the bottom wall, wherein the outlet opening is in the shape of an elongated slit having a centerline which is a circular arc with respect to the longitudinal axis, wherein the inlet opening is spaced apart from the longitudinal axis by a radial distance, and wherein the inlet opening is spaced apart from the apex by an axial distance which is smaller than said radial distance.

2. The nozzle body of claim 1, wherein the axial distance is half of the radial distance or less.

3. The nozzle body of claim 1, comprising one or more further injection holes each having an inlet opening at the inner surface of the bottom wall and an outlet opening at the outer surface of the bottom wall, each outlet opening being in the shape of an elongated slit having a centerline which is a circular arc with respect to the longitudinal axis, the center lines of the injection hole and the at least one further injection hole being positioned on a common imaginary circle around the longitudinal axis.

4. The nozzle body of claim 1, wherein the outer surface has a dome-shaped portion and an axial distance of the outlet opening from an apex of the dome-shape is smaller than a radial distance of the outlet opening to the longitudinal axis.

5. The nozzle body of claim 1, wherein the inner surface has a flat central portion comprising the apex of the inner surface, a first truncated cone shaped portion upstream of the flat central portion, a cylindrical portion upstream of the first truncated cone shaped portion and a second truncated cone shaped portion upstream of the cylindrical portion, the inlet opening being comprised by the second truncated cone shaped portion.

6. A valve assembly for a fluid injection valve, the valve assembly comprising:

a nozzle body comprising:

a cavity extending along a longitudinal axis towards a fluid outlet end and having a bottom wall delimiting the cavity at the fluid outlet end, wherein the bottom wall includes an inner surface with a concave shape extending along the longitudinal axis away from an apex of the cavity disposed at the fluid outlet end, an injection hole perforating the bottom wall with an inlet opening at an inner surface of the bottom wall and an outlet opening at an outer surface of the bottom wall, wherein the outlet opening is in the shape of an elongated slit having a centerline which is a circular arc with respect to the longitudinal axis, wherein the inlet opening is spaced apart from the longitudinal axis by a radial distance, and wherein the inlet opening is spaced apart from the apex by an axial distance which is smaller than said radial distance, and a seat element configured to move between a closing position in which the seat element abuts a valve seat defined by the inner surface for sealing the injection hole, and an open position in which the seat element is displaced away from the valve seat, wherein the injection hole is unsealed in the open position.

7. The valve assembly of claim 6, wherein the inner surface of the bottom wall has a flat central portion comprising the apex of the inner surface, a first truncated cone shaped portion upstream of the flat central portion, a cylindrical portion upstream of the first truncated cone shaped portion and a second truncated cone shaped portion upstream of the cylindrical portion, the inlet opening being comprised by the second truncated cone shaped portion, and wherein the valve seat comprises the second truncated cone shaped portion.

8. The valve assembly of claim 6, wherein the seat element has a spherical shape at least in a region in which the seat element abuts the valve seat in the closing position.

9. The valve assembly of claim 6, wherein the axial distance is half of the radial distance or less.

10. The valve assembly of claim 6, wherein the nozzle body comprises one or more further injection holes each having an inlet opening at the inner surface of the bottom wall and an outlet opening at the outer surface of the bottom wall, each outlet opening being in the shape of an elongated slit having a centerline which is a circular arc with respect to the longitudinal axis, the center lines of the injection hole and the at least one further injection hole being positioned on a common imaginary circle around the longitudinal axis.

11. The valve assembly of claim 6, wherein the outer surface has a dome-shaped portion and an axial distance of the outlet opening from an apex of the dome-shape is smaller than a radial distance of the outlet opening to the longitudinal axis.

12. A fuel injection valve, comprising:

a valve assembly comprising:

a nozzle body comprising:

a cavity extending along a longitudinal axis towards a fluid outlet end and having a bottom wall delimiting the cavity at the fluid outlet end, wherein the bottom wall includes an inner surface with a concave shape extending along the longitudinal axis away from an apex of the cavity disposed at the fluid outlet end, an injection hole perforating the bottom wall with an inlet opening at the inner surface of the bottom wall and an outlet opening at an outer surface of the bottom wall, wherein the outlet opening is in the shape of an elongated slit having a centerline which is a circular arc with respect to the longitudinal axis, wherein the inlet opening is spaced apart from the longitudinal axis by a radial distance, and wherein the inlet opening is spaced apart from the apex by an axial distance which is smaller than said radial distance, and a seat element configured to move between a closing position in which the seat element abuts a valve seat defined by the inner surface for sealing the injection hole, and an open position in which the seat element is displaced away from the valve seat, wherein the injection hole is unsealed in the open position.

13. The fuel injection valve of claim 12, wherein the inner surface of the bottom wall has a flat central portion comprising the apex of the inner surface, a first truncated cone shaped portion upstream of the flat central portion, a cylindrical portion upstream of the first truncated cone shaped portion and a second truncated cone shaped portion upstream of the cylindrical portion, the inlet opening being comprised by the second truncated cone shaped portion, and wherein the valve seat comprises the second truncated cone shaped portion.

14. The fuel injection valve of claim 12, wherein the seat element has a spherical shape at least in a region in which the seat element abuts the valve seat in the closing position.

15. The fuel injection valve of claim 12, wherein the axial distance is half of the radial distance or less.

16. The fuel injection valve of claim 12, wherein the nozzle body comprises one or more further injection holes each having an inlet opening at the inner surface of the bottom wall and an outlet opening at the outer surface of the bottom wall, each outlet opening being in the shape of an elongated slit having a centerline which is a circular arc with respect to the longitudinal axis, the center lines of the injection hole and the at least one further injection hole being positioned on a common imaginary circle around the longitudinal axis.

17. The fuel injection valve of claim 12, wherein the outer surface has a dome-shaped portion and an axial distance of the outlet opening from an apex of the dome-shape is smaller than a radial distance of the outlet opening to the longitudinal axis.

* * * * *